US006568674B2

(12) United States Patent
Matsuda

(10) Patent No.: US 6,568,674 B2
(45) Date of Patent: May 27, 2003

(54) PAPER FEEDING APPARATUS

(75) Inventor: Yasuhiro Matsuda, Kanazawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 09/955,313

(22) Filed: Sep. 19, 2001

(65) Prior Publication Data

US 2002/0033571 A1 Mar. 21, 2002

(30) Foreign Application Priority Data

Sep. 19, 2000 (JP) ..... 2000-282865

(51) Int. Cl.[7] ..... B65H 5/06

(52) U.S. Cl. ..... 271/274; 271/4.01; 271/3.18; 271/3.2; 271/4.12

(58) Field of Search ..... 271/3.18, 3.2, 271/4.12, 10.11, 10.13, 116, 272, 274

(56) References Cited

U.S. PATENT DOCUMENTS 5,531,431 A * 7/1996 Saito et al. ..... 271/10.09
5,927,705 A * 7/1999 Becker et al. ..... 271/10.13
6,443,446 B1 * 9/2002 Kiesow et al. ..... 271/184

* cited by examiner

*Primary Examiner*—Donald P. Walsh
*Assistant Examiner*—Kaitlin Joerger

(57) ABSTRACT

A paper feeding apparatus including a feed roller supplying paper to a image reading position and a discharge roller discharging the paper. A load in the rotational direction is provided at the discharge roller to prevent the image reading turbulence at the time when the paper is separated from the feed roller.

2 Claims, 7 Drawing Sheets

PAPER FEEDING APPARATUS

CROSS-REFERENCE TO RELATED APPLICATION

This application claims priority from Japanese patent application Serial No. 2000-282865 filed Sep. 19, 2000, the contents of which are incorporated by reference herein.

BACKGROUND OF THE INVENTION

1. Field of the Invention

The present invention relates to a paper feeding apparatus, and more particularly, relates to a paper feeding apparatus wherein it is possible to prevent a image reading turbulence in a image reading device or the like.

2. Description of the Related Art

Conventionally, for example, in a image reading device, in the case where a lot of scripts are automatically carried and read, there is an automatic paper feeding mechanism (ADF). The automatic paper feeding mechanism comprises a pick mechanism which moves a plurality of sheets of paper mounted on a shooter to a specified preparing position; a separating mechanism which takes in the paper put on the preparing position one by one; and a feed mechanism which has a feed roller and a discharge roller for carrying the paper.

FIG. 8 is an description drawing of a conventional embodiment. In FIG. 8, to the feed mechanism, a feed roller 11 and a discharge roller 23 are provided. Furthermore, a driven roller 24 is provided corresponding to each of the feed roller 11 and the discharge roller 23.

At the feed roller 11, a feed roller gear 36 for driving the feed roller 11 is provided. Furthermore, at the discharge roller 23, a discharge roller gear 40 for driving the discharge roller 23 is provided. Then, the feed roller gear 36 is driven through a train of gears 34, 35 by a motor or the like. Furthermore, the discharge roller gear 40 is driven through a train of gears 37, 38, 39 by a motor or the like.

The paper such as a script is supplied to a reading position from the feed roller 11 and discharged by the discharge roller 23. This discharge roller gear 40 is driven by a train of gears 37, 38, 39 or the like, and therefore, there is a backlash between engaged gears. Because of this backlash, there has been such a case where the discharge roller slips and the paper momentarily stops when the rear end of the paper is separated from a pair of rollers (a feed roller 11 and a driven roller 24) just before the reading position.

This slip is caused by the fact <1> in order to prevent a looseness of the paper at the reading position, the discharge roller 23 sends the paper a little faster than the feed roller 11 (the paper is pulled to the discharge roller 23 side), and therefore, a reaction is caused when the rear end of the paper is separated from the pair of rollers just before the reading position and <2> the paper is kicked in the discharge direction by the above described pair of rollers when the rear end of the paper is separated from the pair of rollers just before the reading position.

In the case of the above described conventional embodiment, when the rear end of the paper is separated from the pair of rollers just before the reading position, a image turbulence has clearly been shown. Especially, in the case of a color scanner, it has been shown as a color drift, and shown more remarkably.

SUMMARY OF THE INVENTION

It is an object of the present invention to solve such conventional problems, and to prevent the image turbulence which is caused when the paper is separated from the feed roller.

A paper feeding apparatus of the present invention comprises a feed roller for supplying the paper to image reading position; and a discharge roller for discharging the paper, and to the above described discharge roller, a load in the rotational direction is provided for preventing the image reading turbulence at the time when the paper is separated from the above described feed roller. Therefore, it is possible to prevent the image turbulence which is caused by the slip of the discharge roller when the paper is separated from the feed roller.

Furthermore, the paper feeding apparatus of the present invention further comprises a discharge roller gear for driving the above described discharge roller; and a train of gears for driving the above described discharge roller gear. The above described load is provided at one of the train of gears for driving the above described discharge roller gear to eliminate the backlash between the above described discharge roller gear and the gear to which the above described load is provided. Therefore, even in the case where a load cannot be applied directly on the discharge roller, it is possible to apply a load on the discharge roller.

Furthermore, in the case of the paper feeding apparatus of the present invention, the above described load is preferably a compression spring that is provided between the discharge roller gear for driving the shaft of the above described discharge roller and the bearing of the above described discharge roller. Accordingly, it is unnecessary to provide a mechanism for eliminating the backlash, and it is possible to easily apply a load to the discharge roller by the compression spring.

Furthermore, in the case of the paper feeding apparatus of the present invention, the above described load is a torsion coil spring which comes into contact with the shaft of the above described discharge roller at the inside diameter. Accordingly, it is unnecessary to provide a mechanism for eliminating the backlash, and it is possible to easily apply a load to the discharge roller by the torsion coil spring.

Furthermore, in the case of the paper feeding apparatus of the present invention, it is preferable that the above described load is produced by pressing a body with the character of a spring onto the shaft of the above described discharge roller. Accordingly, it is unnecessary to provide a mechanism for eliminating the backlash, and it is possible to easily apply a load to the discharge roller by pressing a body with the character of a spring.

DETAILED DESCRIPTION OF THE PREFERRED EMBODIMENTS

Outline of Paper Feeding Apparatus of Present Invention

The paper feeding apparatus of the present invention will simply be described by referring to FIG. 1 to FIG. 7.

The paper feeding apparatus of the present invention comprises a feed roller 11 for supplying paper to a image reading position; and a discharge roller 23 for discharging the paper. Furthermore, at the above described discharge roller 23, a load in the rotational direction is provided, which prevents the image reading turbulence at the time when the paper is separated from the above described feed roller 11.

Furthermore, the above described paper feed apparatus comprises a discharge roller gear 40 for driving the above described discharge roller 23; and a train of gears for driving the above described discharge roller gear 40. The above described load is provided at one of the train of gears for driving the above described discharge roller gear 40 to eliminate the backlash between the above described discharge roller gear 40 and the gear 39 at which the above described load is provided.

The above described load is a compression spring which is provided between the discharge roller gear 40 for driving the shaft of the above described discharge roller 23 and the bearing of the above described discharge roller 23. Furthermore, the above described load is a torsion coil spring which comes into contact with the shaft of the above described discharge roller 23 at the inside diameter. Furthermore, the above described load is produced by pressing a body with the character of a spring to the shaft of the above described discharge roller 23.

Description of Outline of Image Reading Device

Figure 1:
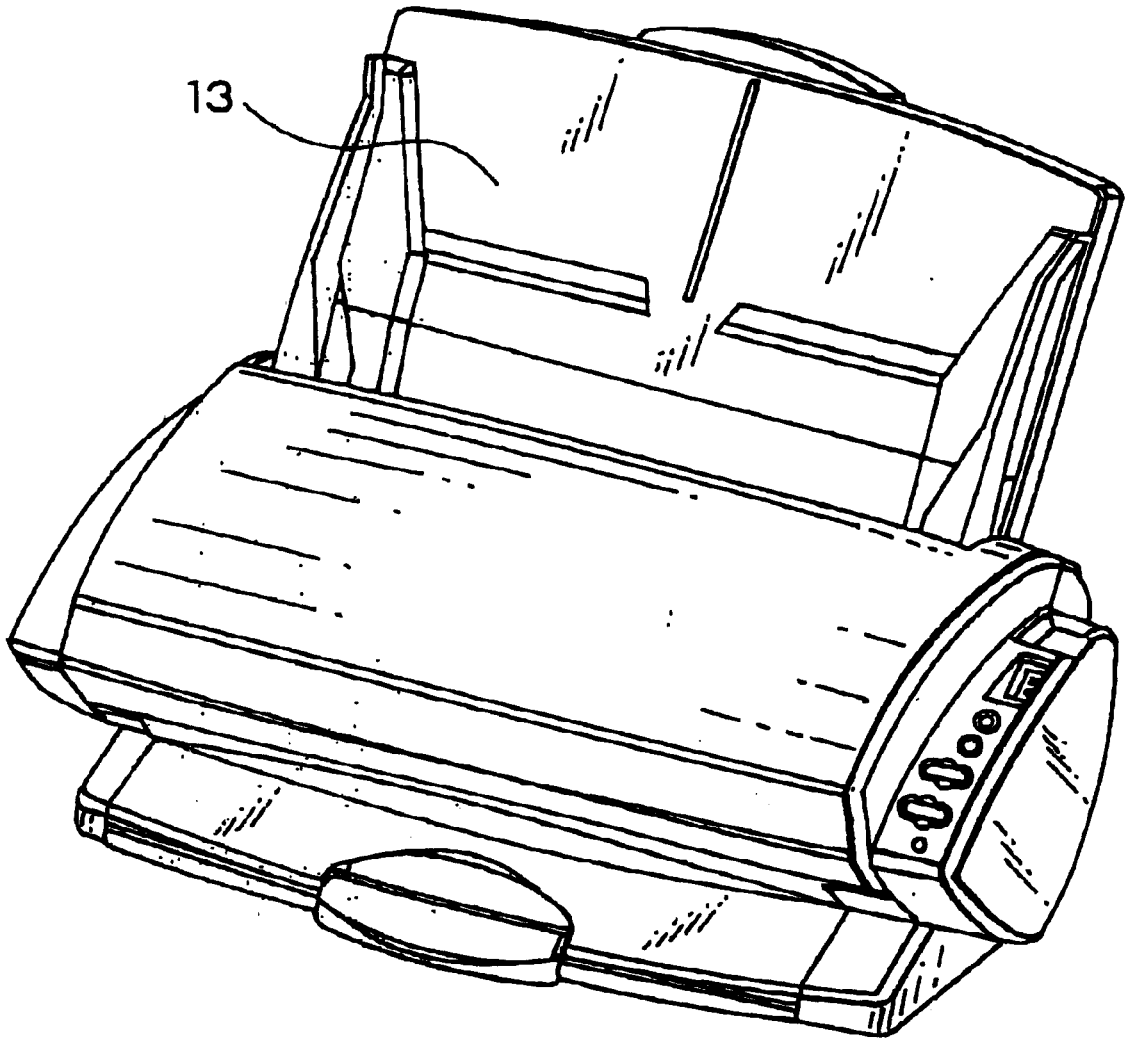
FIG. 1 is an outside drawing of a image reading device in the preferred embodiment.
Figure 2:
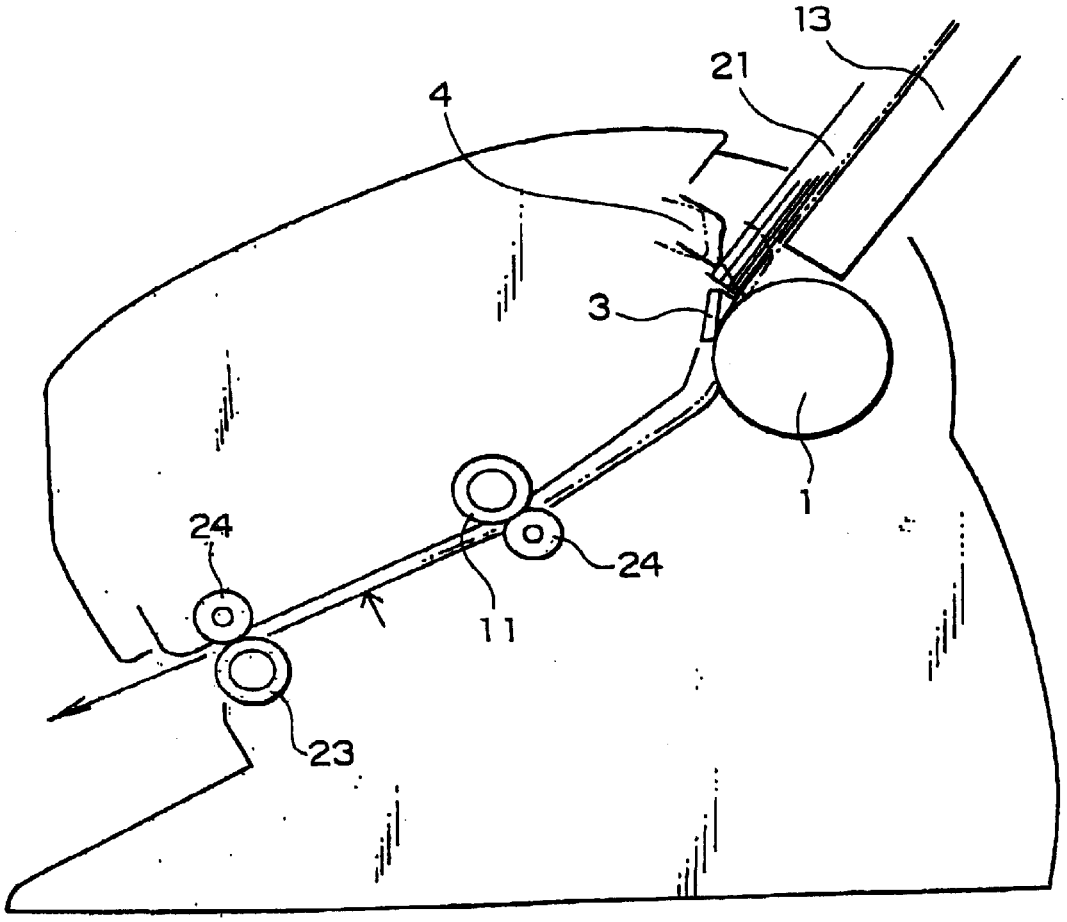
FIG. 2 is a main part description drawing of the image reading device in the preferred embodiment.

FIG. 1 and FIG. 2 are a device outside drawing and a main part description drawing showing the image reading device in the preferred embodiment of the present invention, respectively. In FIG. 1 and FIG. 2, the image reading device has a shooter 13 to which the script that is the object to be read is set in the rear part and a paper feeding apparatus in the interior, respectively. The paper feeding apparatus includes a pick mechanism for moving a plurality of sheets of paper 21 mounted on the shooter 13 to a specified preparing position, a separating mechanism for taking in the sheets of paper put on the preparing position one by one, and a feed mechanism having a feed roller 11 and a discharge roller 23 for carrying the paper. Furthermore, the arrow positioned between the feed roller 11 and the discharge roller 23 shows the reading position of the image.

The pick mechanism is formed near the paper supply port of the shooter 13, and takes out a plurality of scripts 21 (including paper or the like containing characters, figures, marks or the like) mounted on the shooter 13 from the lower side in turn by the pick roller 1 and the pick arm 4, and moves the paper to the specified preparing position.

The separating mechanism takes in the sheets of paper put on the preparing position one by one by the separating pad 3 which comes into sliding contact with the pick roller 1.

The feed mechanism supplies the paper to the reading position by the feed roller 11, and discharges it by the discharge roller 23.

Description of Driving System of Paper Carrying

Figure 3:
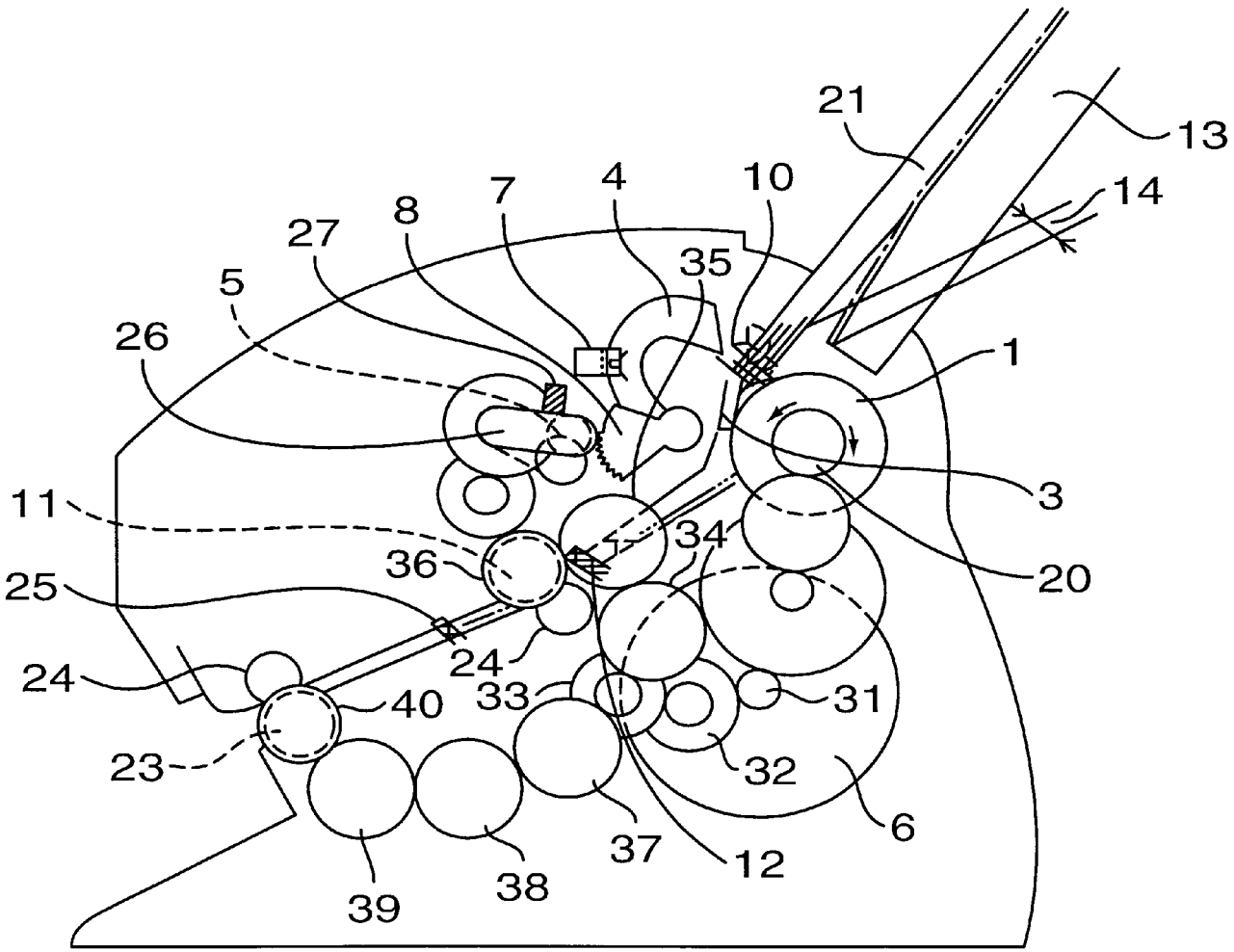
FIG. 3 is a main part description drawing showing a driving system of a paper carrying in the preferred embodiment.

FIG. 3 is a main part description drawing showing the driving system of the paper carrying in the preferred embodiment of the present invention. In FIG. 3, a paper carrying motor 6 drives a pick roller 1, a feed roller 11, and a discharge roller 23 by a train of gears to perform the paper carrying. Furthermore, a pick roller driving gear 20 for driving the pick roller 1 has a one-way clutch, and is formed so that it rotates only in the counterclockwise direction. Furthermore, a driven roller 24 is provided corresponding to each of the feed roller 11 and the discharge roller 23.

The pick arm driving gear 8 has a rotary pivot, and connects the pick arm 4. A planetary gear 5 is rotatably connected to a planetary gear frame 26, and is arranged to be engaged with the pick arm driving gear 8. Furthermore, the planetary gear 5 is arranged to be driven through a train of gears by the rotation of the feed roller 11. Furthermore, a planetary gear frame stopper 27 regulates the range of rotation of the planetary gear frame 26.

In the driving of the pick arm 4, when the pick arm 4 is positioned at the lower position and held in the paper feeding time position, the planetary gear 5 is separated from the pick arm driving gear 8 by the positive rotation of the motor 6 to position the pick arm 4 at the lower position. On the other hand, when the pick arm 4 is positioned at the upper position and held in the waiting time position, the planetary gear 5 is engaged with the pick arm driving gear 8 by the reverse rotation of the motor 6 to position the pick arm 4 at the upper position.

A pick arm state detecting sensor 7 detects the pick arm 4 which is positioned at the upper position when the planetary gear 5 is engaged with the pick arm driving gear 8 by the reverse rotation of the motor 6. Consequently, when the pick arm 4 is positioned at the upper position, the motor 6 is reversed to move the pick arm 4 upward until the pick arm state detecting sensor 7 sends a signal detecting the pick arm 4.

A detecting sensor 10 of the paper on the shooter is packaged to have a positional relation so that it remains OFF even if the script 21 is set to the shooter 13 in the state where the pick arm 4 is positioned at the lower position, and it turns ON in the case of setting the script 21 to the shooter 13 in the state where the pick arm 4 is positioned at the upper position. Consequently, in the action of positioning the pick arm 4 at the upper position in the initialization or resetting of the apparatus, in the state where the detecting sensor 10 of the paper on the shooter sends a signal of detecting the existence of paper, it is arranged that the action of positioning the pick arm 4 at the upper position is not performed.

A paper sensor 12 between the pick and feed detects the existence of paper between the pick roller 1 and the feed roller 11 of the paper supply passage. Thereby, in the case where the paper sensor 12 between the pick and feed sends a signal of detecting no paper, that is, in the case where no paper is picked up, it is arranged that the reverse and positive rotational actions of the motor 6 are repeated, and the tip of the pick arm 4 is moved up and down to hit the paper mounted on the shooter 13.

A detecting sensor 25 of the tip and rear end of the paper detects the tip and rear end of the paper. Thereby, the tip of the paper is detected by the detecting sensor 25 of the tip and rear end of the paper, and by the signal of this detecting sensor 25 of the tip and rear end of the paper, the reading of the paper (script 21) is started. Then, when the detecting sensor 25 of the tip and rear end of the paper detects the rear end of the paper, the reading is finished, and by the discharge roller 23, the paper is discharged to a stacker which is not shown in the drawing or the exterior of the apparatus Furthermore, in the shooter 13, a step 14 inclined in the paper entering direction is formed by letting the height near the paper supply port be one stage. Furthermore, the paper separating pad 3 comes into sliding contact with the pick roller 1 to take in the scripts 21 one by one.

Description of Feed Mechanism

Figure 4A:
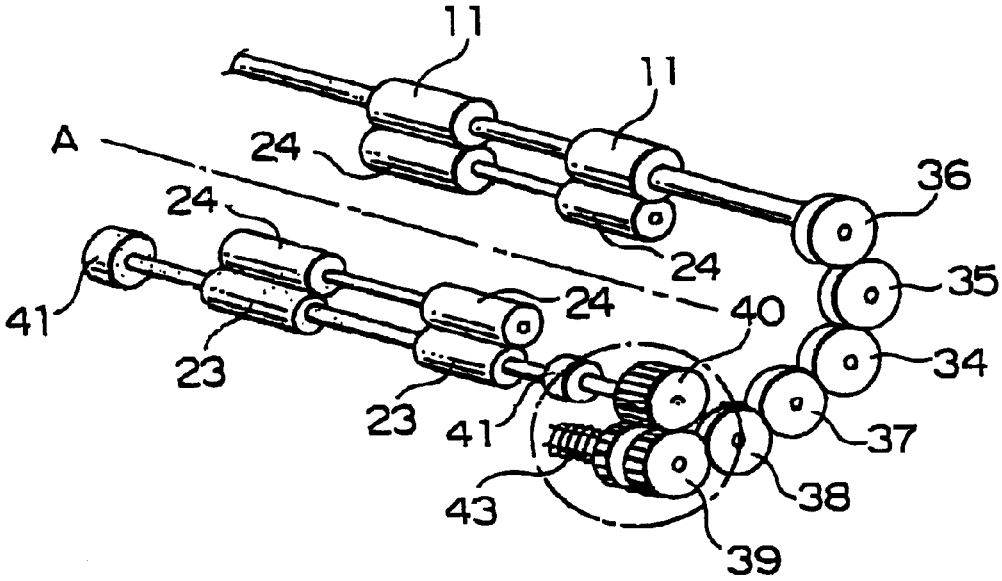
FIG. 4A and FIG. 4B are description drawings of a feed mechanism in the preferred embodiment.
Figure 4B:
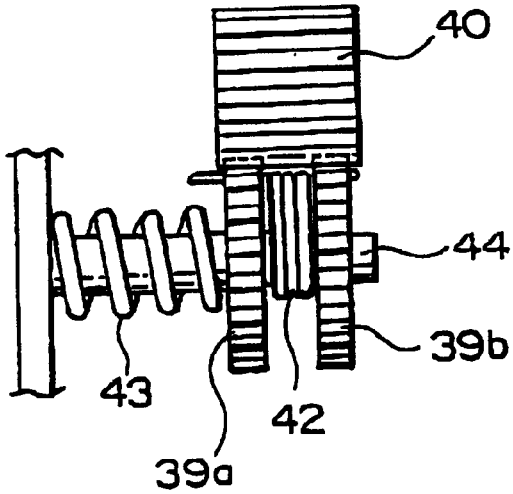

FIGS. 4A and 4B are description drawings of the feed mechanism of the present invention. In FIGS. 4A and 4B, reference numeral 11 denotes a feed roller, reference numeral 23 denotes a discharge roller, reference numeral 24 denotes a driven roller, reference numerals 34, 35, 36, 37, 38, 39, 40 denote gears, reference numeral 41 denotes a bearing, and reference numeral 43 denotes a compression spring (load).

FIGS. 4A and 4B are description drawings of the feed mechanism in the preferred embodiment of the present invention. FIG. 4A is a description drawing of the feed roller 11 and the discharge roller 23, and FIG. 4B is an enlarged view of the discharge driving part.

In FIG. 4A, at the feed mechanism, a feed roller 11 and a discharge roller 23 are provided. Furthermore, a driven roller 24 is provided at each of the feed roller 11 and the discharge roller 23.

At the feed roller 11, a feed roller gear 36 for driving the feed roller 11 is provided. The feed roller gear 36 is driven through a train of gears 34, 35 by a motor.

Furthermore, at the discharge roller 23, at the right end, a discharge roller gear 40 for driving the discharge roller 23 is provided, and is rotatably pivoted by a bearing 41 made of a metal for increasing the accuracy. The discharge roller gear 40 is driven through a train of gears 37, 38, 39 by a motor.

The paper is supplied to the reading position from the feed roller 11, and discharged by the discharge roller 23. A compression spring 43 is provided at the gear 39 for preventing the paper from instantaneously stopping because of the slip of the discharge roller, when the rear end of the paper is separated from the pair of rollers (a feed roller 11 and a driven roller 24) before the reading position.

In FIG. 4B, the gear 39 for driving the discharge roller gear 40 includes two gears 39*a* and 39*b*, and is rotatably pivoted by a fixation shaft 44. Between these two gears 39*a* and 39*b*, a torsion coil spring 42 is provided to eliminate the backlash between the discharge roller gear 40 and the gear 39. Furthermore, between the gear 39*a* and the frame of the attaching part, a compression spring 43 is provided, and by the compression spring 43, a load (hanging) in the rotational direction is applied to the discharge roller 23. This load has a power of a degree for preventing the slip of the discharge roller when the rear end of the paper is separated from the pair of rollers before the reading position.

Thereby, when the rear end of the paper is separated from the pair of rollers before the reading position, it does not occur for the discharge roller 23 to slip, and it is possible to prevent the paper from instantaneously stopping, and the reading turbulence of the image can be prevented.

Furthermore, here, a case where a load is provided at the gear 39 is described, but it is also possible to provide a load to another gear (gear 38 or 37 or the like) of the train of gears for eliminating the backlash.

Description of Case Where Load is Directly Applied to Discharge Roller

Figure 5:
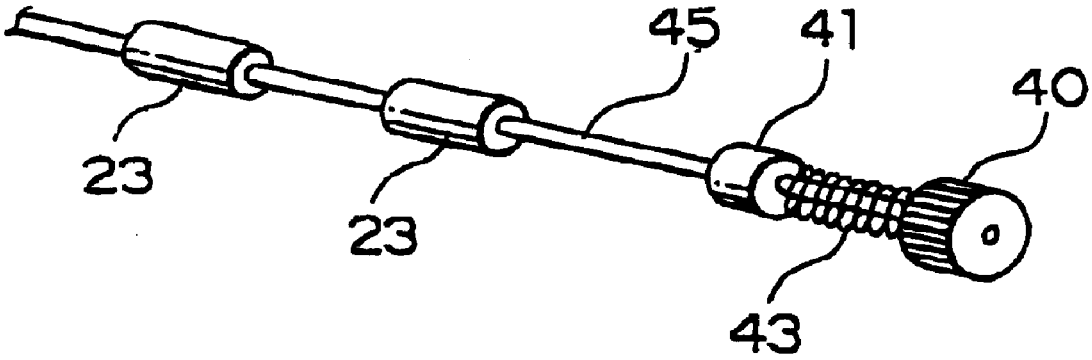
FIG. 5 is an description drawing in the case where a compression spring is used in the preferred embodiment.

In the above described embodiment, a case where a load is applied to part of the train of gears is described, but it is also possible to directly apply a load to the discharge roller 23. FIG. 5 is a description drawing in the case where a compression spring is used, FIG. 6 is a description drawing in the case where a torsion coil spring is used, and FIGS. 7A through 7C are description drawings in the case where a body with the character of a spring is pressed.

In FIG. 5, between the bearing 41 of the discharge roller 23 and the discharge roller gear 40, a compression spring 43 is provided. Furthermore, the bearing 41 is fixed in the axial direction of the discharge roller 23 with a frame or the like, and does not rotate. Consequently, when the rear end of the paper is separated from the pair of rollers before the reading position, it does not occur for the discharge roller 23 to slip, and it is possible to prevent the paper from instantaneously stopping, and the reading turbulence of the image can be prevented. Furthermore, a load is directly applied to the discharge roller 23, and therefore, it is unnecessary to provide a mechanism for eliminating the backlash which has been described in FIG. 4.

Figure 6:
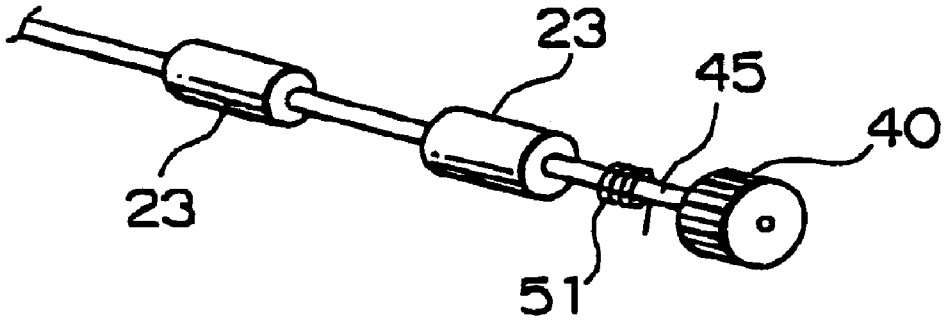
FIG. 6 is an description drawing in the case where a torsion coil spring is used in the preferred embodiment.

In FIG. 6, at the shaft 45 of the discharge roller 23, a torsion coil spring 51 whose one end is fastened to the rigid part such as the frame is provided. Consequently, the shaft diameter of the discharge roller 23 and the inside diameter of the torsion coil spring 51 are set to be fastened in the rotational direction, and a load (hanging) is applied to the shaft 45. In this case, when the rear end of the paper is separated from the pair of rollers before the reading position, it also does not occur for the discharge roller 23 to slip, and it is possible to prevent the paper from instantaneously stopping, and the reading turbulence of the image can be prevented, and furthermore, a load is directly applied to the discharge roller 23, and therefore, it is unnecessary to provide a mechanism for eliminating the backlash.

Figure 7A:
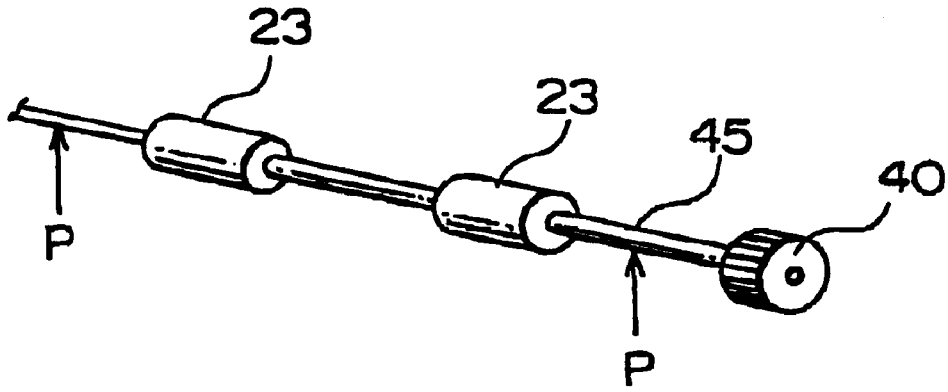
FIG. 7A, FIG. 7B, and FIG. 7C are description drawings in the case where a body with the character of a spring is pressed in the preferred embodiment.
Figure 7B:
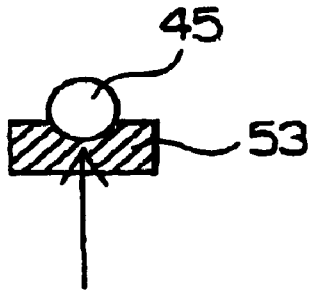
Figure 7C:
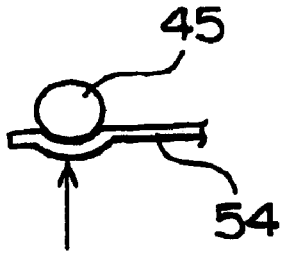
Figure 8:
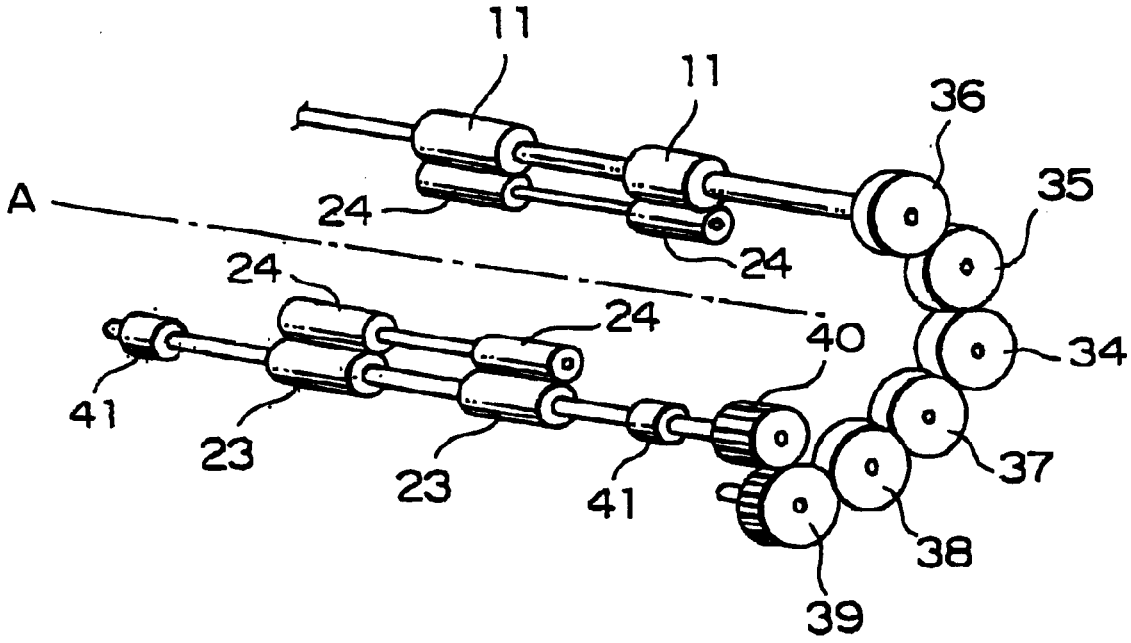
FIG. 8 is an description drawing of a conventional embodiment.

FIG. 7A is an description drawing of the case where a body with the character of a spring is pressed. In the case of FIG. 7A, a load is applied to the discharge roller 23, by pressing a body of rubber or sponge, or a body (elastic body) with the character of a spring made of resin or a metal from the frame of the attaching part to the part P shown by the arrow or the like (applying pressure). Furthermore, in FIG. 7A, two places (parts P shown by an arrow) on which the load is applied are provided, but it is possible to provide either one.

FIG. 7B is an description drawing of the case where a body of rubber or sponge is used. In the case of FIG. 7B, a body 53 of rubber or sponge is pressed from the direction shown by the arrow to the discharge roller shaft 45.

FIG. 7C is an description drawing of the case where a body with the character of a spring made of resin or a metal is used. In the case of FIG. 7C, a body 54 with the character of a spring made of resin or a metal is pressed from the direction shown by the arrow to the discharge roller shaft 45 from the frame of the attaching part.

Furthermore, in the description of FIGS. 4A and 4B, a case where a compression spring is used as a load has been described, but it is also possible to apply a load by pressing a body of rubber or sponge, or a body (elastic body) with the character of a spring made of resin or a metal from the frame of the attaching part to the rotary part of the gear 39 (applying pressure).

As described above, according to the present invention, there are the following effects.

At the discharge roller, a load in the rotational direction is provided for preventing the image reading turbulence at the time when the paper is separated from the feed roller, and therefore, it is possible to prevent the image turbulence caused by the slip of the discharge roller when the paper is separated from the feed roller.

Furthermore, a load is provided at one of the train of gears which drive the discharge roller to eliminate the backlash between the discharge roller gear and the gear to which a load is provided, and therefore, even in the case where a load cannot be applied directly to the discharge roller, a load can be applied to the discharge roller.

Furthermore, a compression spring which is provided between the discharge roller gear for driving the shaft of the discharge roller and the bearing of the discharge roller is made to be a load, and therefore, it is unnecessary to provide a mechanism for eliminating the backlash, and a load can easily be applied to the discharge roller by the compression spring.

Furthermore, a torsion coil spring which comes into contact with the shaft of the discharge roller at the inside diameter is made to be a load, and therefore, it is unnecessary to provide a mechanism for eliminating the backlash, and a load can easily be applied to the discharge roller by the torsion coil spring.

Furthermore, a load is produced by pressing a body with the character of a spring to the shaft of the discharge roller, and therefore, it is unnecessary to provide a mechanism for eliminating the backlash, and a load can easily be applied to the discharge roller by pressing a body with the character of a spring.

What is claimed is:

1. A paper feeding apparatus comprising:

a feed roller to supply paper to an image reading position;

a discharge roller to discharge the paper;

a body to apply a load in a rotational direction to the discharge roller, the load in the rotational direction preventing image reading turbulence when the paper is separated from the feed roller;

a discharge roller gear to drive the discharge roller; and a train of gears to drive the discharge roller gear, wherein the body is provided at one gear of the train of gears to eliminate a backlash between the discharge roller gear and the one gear at which the body is provided.

2. A paper feeding apparatus according to claim 1, wherein the body comprises a torsion coil spring contacting a shaft of the discharge roller at an inside diameter of the torsion coil spring.

* * * * *